US005255835A

United States Patent [19]

Burks

[11] Patent Number: 5,255,835

[45] Date of Patent: Oct. 26, 1993

[54] RUNNER'S WRITING PAD, PENCIL AND RECORDER POUCH

[76] Inventor: Rufus W. Burks, 620 Sheridan St. Apt. #307, Hyattsville, Md. 20783-3206

[21] Appl. No.: 797,934

[22] Filed: Nov. 26, 1991

[51] Int. Cl.[5] ..... A45P 3/00

[52] U.S. Cl. ..... 224/228; 224/224; 224/227; 224/237; 224/252; 224/151; 150/112

[58] Field of Search ..... 224/224, 226, 227, 228, 224/229, 252, 253, 235, 236, 237, 240, 241, 151; 150/112, 114, 131, 132; 190/903

[56] References Cited

U.S. PATENT DOCUMENTS

| | | | |
|---|---|---|---|
| 138,217 | 4/1873 | Wendt | 150/112 |
| 1,607,007 | 11/1926 | Leviten et al. | 150/112 |
| 1,745,590 | 2/1930 | Stanger . | |
| 2,315,095 | 3/1943 | Rhodes | 224/226 |
| 2,346,185 | 4/1944 | Perry | 224/227 |
| 2,612,199 | 9/1952 | Schocket | 150/112 |
| 4,119,249 | 10/1978 | Hanson . | |
| 4,284,220 | 8/1981 | Nice . | |
| 4,569,465 | 2/1986 | O'Farrell . | |
| 4,645,105 | 2/1987 | Plumbridge . | |
| 4,699,303 | 10/1987 | Kline . | |
| 4,705,086 | 11/1987 | O'Neill . | |
| 4,744,497 | 5/1988 | O'Neal . | |
| 4,801,059 | 1/1989 | Hayes . | |
| 4,893,739 | 1/1990 | Conner . | |
| 4,998,653 | 3/1991 | LaBelle . | |
| 5,025,965 | 6/1991 | Smith | 224/224 |

FOREIGN PATENT DOCUMENTS

| | | | |
|---|---|---|---|
| 1519783 | 4/1968 | France | 224/236 |
| 68750 | 1/1915 | Switzerland | 224/236 |

*Primary Examiner*—Linda J. Sholl

*Attorney, Agent, or Firm*—Jacobson, Price, Holman & Stern

[57] ABSTRACT

A runner's writing pad, pencil and recorder pouch is adapted for carrying at the runner's waist. The pouch may also be used for other activities and worn with any sports wear or casual wear. The pouch has an upper section and a lower section, each including an upper edge and a lower edge. In closed position, the upper edge of the upper section is folded forward and joined to the lower edge of the upper section and in open position the upper edge of the upper section is extended upward, away from the lower edge of the upper section, to expose at least one pocket adapted for receiving a writing pad, pencil and/or a mini-tape recorder, radio or pager. A lower section of the pouch includes an upper edge adjacent the lower edge of the upper section and a lower edge remote from the upper section when the pouch is in closed position. In closed position the lower edge of the lower section is folded forward and joined to the upper edge of the lower section and in open position the lower edge of the lower section is extended downward away from the upper edge of the lower section to expose at least one pocket. The lower section may also include a separate pocket for a mini-recorder, radio or pager, in addition to the pocket in the upper section in which such an article may be carried.

21 Claims, 3 Drawing Sheets

FIG. 1
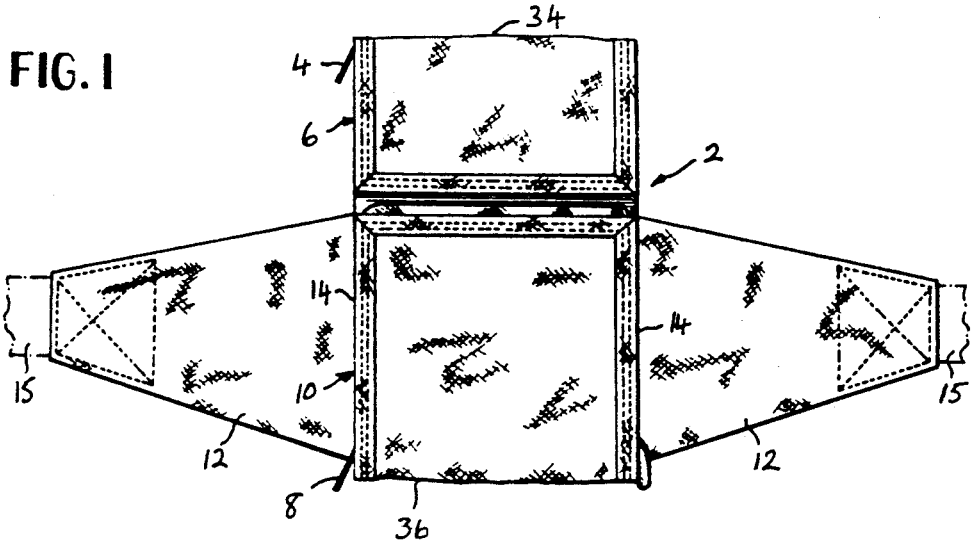
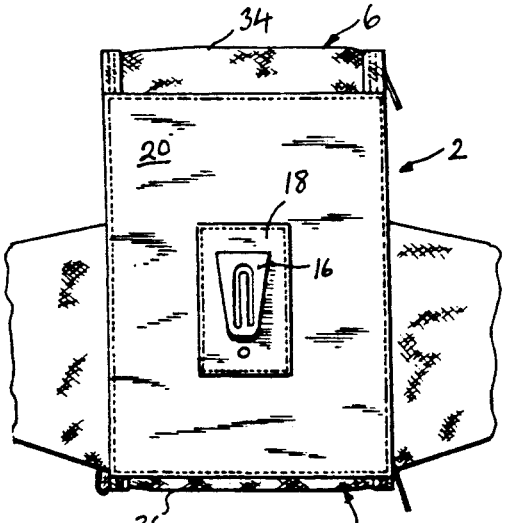
FIG. 2
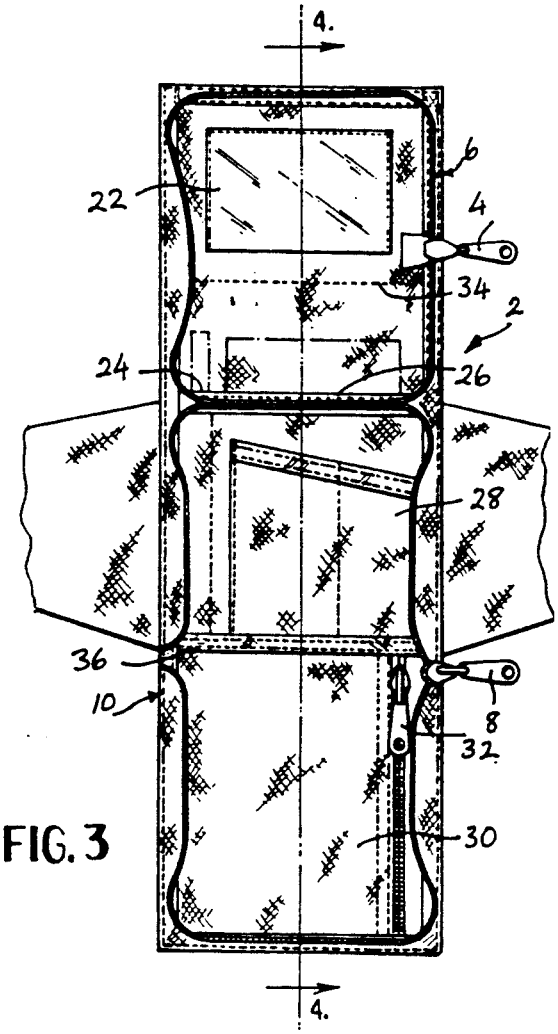
FIG. 3

RUNNER'S WRITING PAD, PENCIL AND RECORDER POUCH

FIELD OF THE INVENTION

The invention relates to devices for carrying useful articles while running or jogging.

BACKGROUND OF THE INVENTION

Known devices do not address the problem of carrying a pad and pencil or a mini-tape recorder, radio or pager while running or engaging in other activity where it is not convenient to carry such items on the person and/or where the clothing worn does not include pockets.

Plumbridge, U.S. Pat. No. 4,645,105, describes a golfer's accessory which clips onto a golf bag or trouser waist band. O'Farrell, U.S. Pat. No. 4,569,465, describes a sport belt including a stereo unit. The stereo unit is fastened to a belt which is strapped around the waist of an athlete. Nice, U.S. Pat. No. 4,284,220, describes a belt carried notebook and holster. The notebook is carried in an open pouch.

Hanson, U.S. Pat. No. 4,119,249, describes an article carrier having two side-by-side pouches with flap closings. Stanger, U.S. Pat. No. 1,745,590, concerns a waterproof muff and schoolbag which is suspended from a person's neck. U.S. Pat. No. 4,699,303, to Kline, describes another golf article retaining device for clipping onto a golf bag.

U.S. Pat. No. 4,705,086, to O'Neill, describes a wallet which clips onto a jogger's belt. The wallet is adapted for containing items such as coins and keys. O'Neal, U.S. Pat. No. 4,744,497, describes a security wallet for hanging around a user's neck. Hayes, U.S. Pat. No. 4,801,059, concerns a pocket calculator holder which is also suspended around a user's neck.

Conner, U.S. Pat. No. 4,893,739, describes a pocket for golf accessories, designed to carry golf balls, pencils, golf tees, etc. The device has a loop for retaining a belt. The device of LaBelle, U.S. Pat. No. 4,998,653, also includes a slot for retaining a belt, thereby enabling attachment of a concealable pouch to the user's body.

SUMMARY OF THE INVENTION

A person may want to make an instantaneous record of thoughts and ideas which occur while running, jogging, biking or otherwise exercising or while marketing or shopping. Such information may be written on a pad or dictated into a mini-tape recorder to avoid forgetting these thoughts and ideas which might otherwise not be remembered. Also, a person may want to carry a small radio or pager when not wearing a garment having convenient pockets. The pouch provides easy access to a pad, either for writing or for reference to a list, such as a grocery list, which has been written previously. The pouch of the invention may appropriately be worn with running clothes or with any other sports wear or casual wear.

The runner's writing pad, pencil and recorder pouch of the invention has two sections, each of which includes a flap which, when opened, allows the pouch to be laid flat to expose pockets. The flaps fold over the pockets to close the pouch. The upper section opens upward and the lower section opens downward. When both sections are open, the pouch is fully extended and lies substantially flat. When both sections are closed, the pouch is compactly folded for ease of carrying around a user's waist. In a preferred embodiment, a zip fastener closes the perimeter of each section. A velcro tape closing may also be used.

In a first embodiment, the upper section opens upward to reveal pockets for a writing pad and pencil. A mini-tape recorder, radio or pager may be substituted for the writing pad. These items are immediately available to the runner, or other user, merely by opening a zip fastener. The lower section opens downward to reveal a separately closable coin purse and a pocket for keys. In a second embodiment, a pocket for a pad is located in the upper section and a pocket for a mini-tape recorder, radio or pager is located in the lower section.

It is an object of the invention to provide a pouch for a runner's writing pad, pencil and mini-tape recorder, radio or pager, as described and illustrated below.

BRIEF DESCRIPTION OF THE DRAWINGS

FIG. 1 is a front elevational view of a closed pouch of the invention, having a belt portion broken off and shown in phantom.

FIG. 2 is a rear elevational view of the pouch of FIG. 1.

FIG. 3 is a front elevational view of a fully open pouch of FIG. 1.

DETAILED DESCRIPTION OF THE INVENTION

Figure 4:
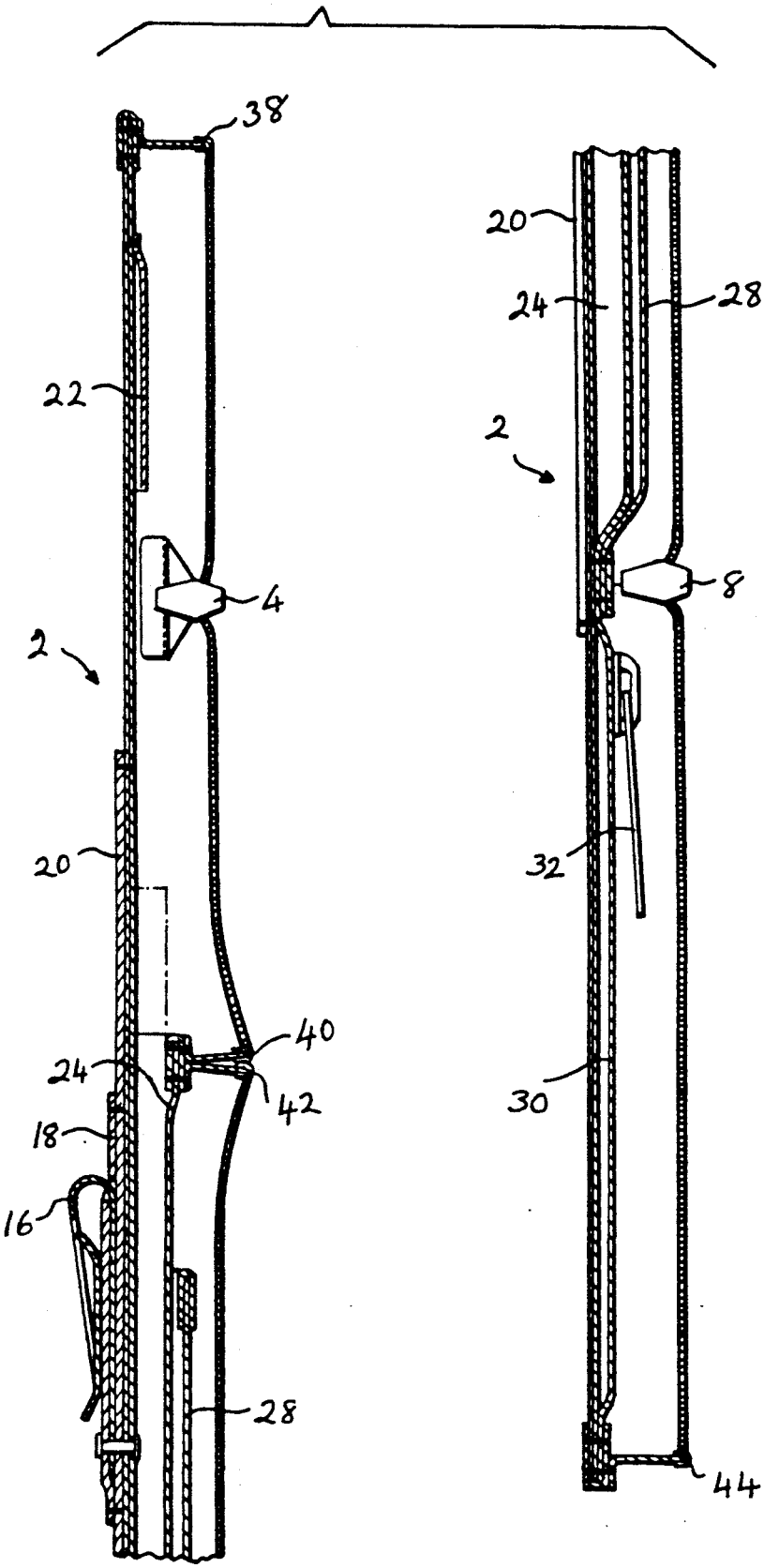
FIG. 4 is a cross-sectional view taken on line 4—4 of FIG. 3.

A runner's writing pad, pencil and mini-recorder pouch has an upper section and a lower section, each section including an upper edge and a lower edge. In open position, the upper edge of the upper section is extended upward, away from the lower edge of the upper section, to expose at least one pocket adapted for receiving a writing pad and pencil or a mini-tape recorder, radio or pager. In closed position, the upper edge of the upper section is folded forward and joined to the lower edge of the upper section.

The lower section of the pouch includes an upper edge adjacent the lower edge of the upper section and a lower edge remote from the upper section when the lower section pouch is open. When the lower section is closed, the lower edge of the lower section is folded forward and joined to the upper edge of the lower section. When the lower section is open, the lower edge of the lower section is extended downward away from the upper edge of the lower section to expose at least one pocket.

In a first embodiment of the invention, the lower section includes a closable money pocket and a pocket for keys and the like. In a second embodiment, the lower section further includes a pocket for a mini-recorder, radio or pager. This pocket may be closed by a flap with a snap fastener, velcro fastener, or other closure known in the art.

The pouch is adapted for use clipped to a belt and/or the pouch has an attached belt.

With reference to the drawings, in which like numerals represent like parts, FIGS. 1 to 5 represent a runner's pouch for carrying a writing pad and pencil and/or a mini-tape recorder, radio or pager. FIG. 1 illustrates pouch 2 in closed position with zip fastener 4 closing upper section 6 and zip fastener 8 closing lower section 10. Side panels 12 are attached to sides 14 of pouch 2. A belt 15 (shown broken off, in phantom) is attached to side panels 12, for attaching around the user's waist, as known in the art.

FIG. 2 shows the rear side of pouch 2. Hook 16 is attached to reinforcing panel 18 on rear panel 20 of pouch 2. Hook 16 is generally a metal hook or a plastic hook which may be engaged over the waistband of a garment worn by the user of the device. Rear panel 20 extends substantially over the rear face of pouch 2 when both sections of the pouch are closed.

FIG. 3 shows pouch 2 in fully open configuration. Zip fastener 4 opens to reveal upper section 6 of pouch 2 having identification card slot 22, pocket 24 for receiving a pen or pencil (shown in phantom) and pocket 26 for receiving a writing pad, mini-tape recorder, radio or pager (shown in phantom). Zip fastener 8 opens to reveal lower section 10 of pouch 2 having pockets 28 for keys and/or other small items and pocket 30, closed by zip fastener 32, for coins and/or other money. Upper section 6 is folded about fold 34 so that zip fastener 4 may be closed, joining upper edge 38 and lower edge 40 of upper section 6. Lower section 10 is folded about fold 36 so that zip fastener 8 may be closed, joining upper edge 42 and lower edge 44 of lower section 10.

FIG. 4 illustrates pouch 2 in cross-section. It can be clearly seen how the layers and sections of the pouch are assembled. Flat rear panel 20 extends substantially between the folds and is used to support the length of the pad, mini-recorder, radio or pager. This section is reinforced by rear panel 20 which is preferably a flat, relatively stiff sheet, as described above. As the upper section opens upward and the lower section opens downward, this flat portion is not liable to be crushed or folded but is cushioned and protected by the folded portions when zip fasteners 4 and 8 are closed. Thus, the writing pad, mini-recorder, radio or pager are not likely to be damaged while the user is running. Further, the design accommodates the thickness of a writing pad, mini-tape recorder, radio or pager in pocket 24, between the pocket layer and the layer forming the back of the pouch.

Figure 6:
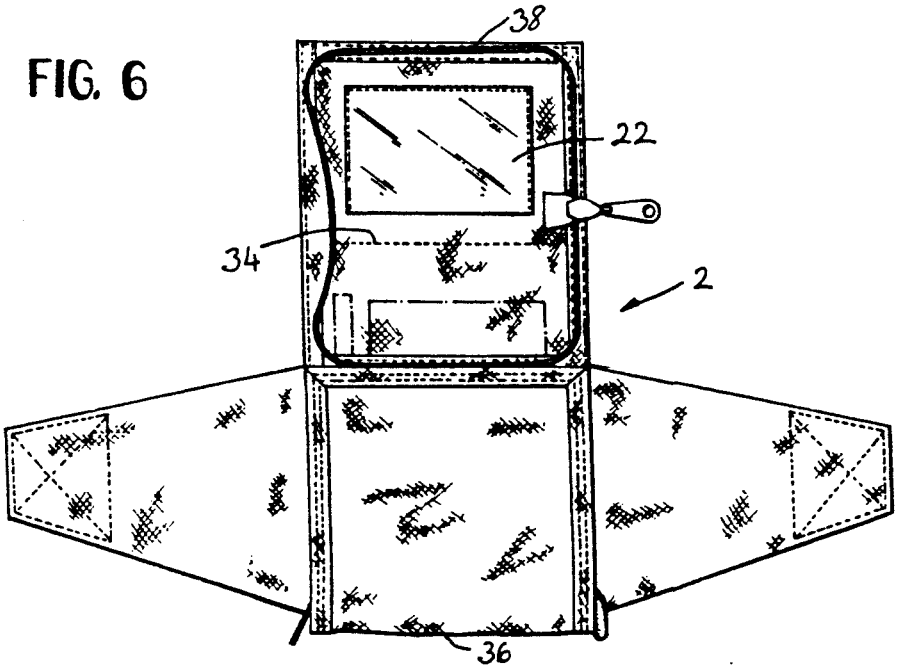
FIG. 6 is a front elevational view of a pouch of the invention having the upper section open and the lower section closed.

An important feature of the invention, clearly shown in FIG. 6, allows access to the writing pad, mini-recorder, radio or pager in pocket 24 by opening only the upper section zip fastener, as pocket 24 opens into the upper section. Pocket 24 is accessed from the upper section while the majority of the length of the article in pocket 24 is actually stored behind the lower section 10 of the pouch. The zip fastener for the lower section may remain closed while gaining access to the pockets in the upper section.

Figure 5:
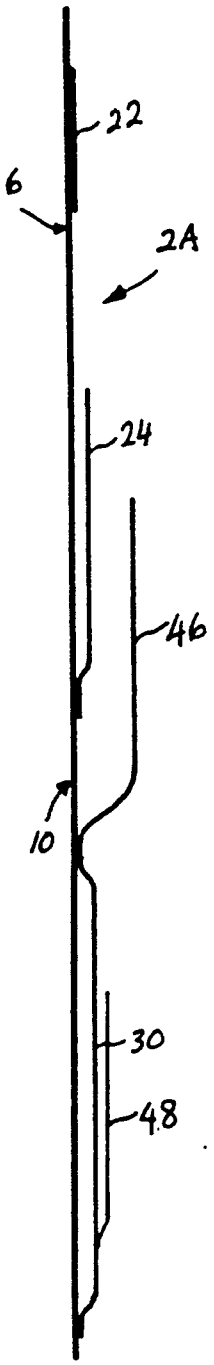
FIG. 5 is a schematic sectional view of another embodiment of the invention, having a separate pocket for receiving a mini-recorder, radio or pager.
Figure 7:
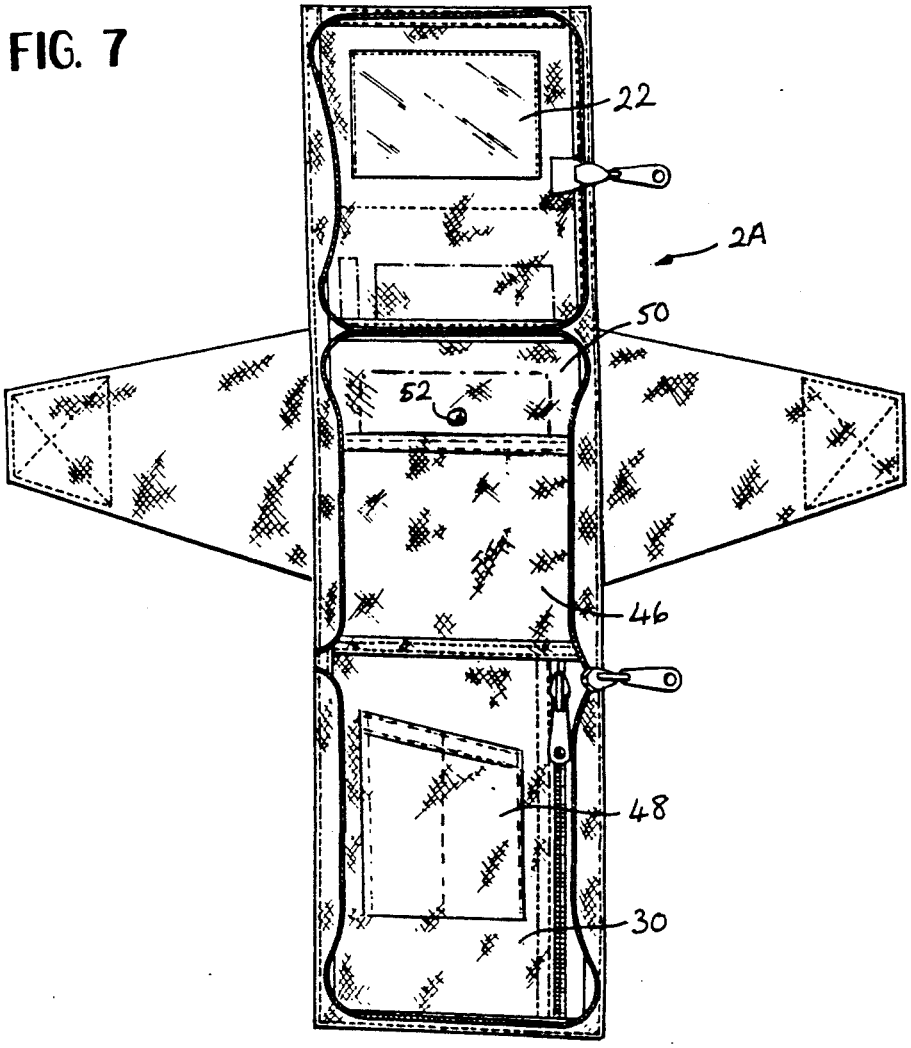
FIG. 7 is a front elevational view of another pouch of the invention, fully open.

FIG. 5 illustrates schematically, in section, and FIG. 7, illustrates in elevational view, a further embodiment 2A of the invention in which the upper section is similar to that shown in FIG. 3. Lower section 10 includes a further pocket 46 for a tape recorder, radio or pager in addition to pocket 24 for a writing pad accessed from upper section 6, as described above. Pocket 46 may be lined with a sheet of foam material for cushioning and for stabilizing the position of the mini-recorder, radio or pager in the pocket. Alternatively, pocket 46 may be made of elasticated, stretch fabric which holds the recorder, radio or pager firmly in place while the wearer of the pouch is running. A covering flap 50, closed by a snap fastener 52 or by velcro tape may also be used to hold the mini-recorder securely in pocket 46. Key pocket 48, is located on the outside of coin pocket 30 and may be closed by a fastener, such as a zip fastener, or by a flap and snap fastener or velcro tape. In this embodiment, lower section 10 is generally a little longer than in the embodiment shown in FIGS. 1 to 4, to accommodate the length of the mini-recorder, radio or pager.

The pouch is made with an outer layer and an inner layer, both of which may, in a non-limiting example, be made of waterproof nylon material, such as nylon taffeta. The outside front panels and the inside panels of the pouch may be made of waterproof woven nylon fabric. Rear panel 20 and reinforcing panel 18 may be made of waterproof nylon fabric, leather, artificial leather, vinyl sheet material or other preferably stiff, waterproof material. Bright colors are preferred for visibility and attractiveness, although dark colors or camouflage may also be used. Other materials will be known to one skilled in the art.

In a non-limiting example, the pouch may be about 16 inches long when both the upper section and the lower section are open and about 8 inches long when the pouch is closed. The open upper section, as illustrated in FIG. 3, is about 6 inches long and the open lower section, as illustrated in FIG. 3, is about 10 inches long. The pouch may be about 5 inches wide between the belt attachment side panels 12.

Other variations in the material of the pouch and the sizes and arrangement of the pockets and the zip fasteners, in which the upper section opens upward and the lower section opens downward will be apparent to one skilled in the art. The zip fasteners may be locked with small locks, for safety. If required, one or more of the various zip fasteners my be replaced by velcro tape fastenings, within the scope of the invention.

While the invention has been described above with respect to certain embodiments thereof, it will be appreciated that variations and modifications may be made without departing from the spirit and scope of the invention.

What is claimed is:

1. A runner's writing pad, pencil and recorder pouch adapted for being carried at a user's waist while running and comprising:

a pouch comprising:

an upper section including an upper edge and a lower edge, wherein in closed position said upper edge of said upper section is folded forward and joined to and at said lower edge of said upper section and in open position said upper edge of said upper section is extended upward, away from said lower edge of said upper section, to expose access to a pocket adapted for receiving a writing pad or a mini-tape recorder, radio or pager, a lower section including an upper edge adjacent said lower edge of said upper section and a lower edge, wherein in closed position said lower edge of said lower section is folded forward and joined to and at said upper edge of said lower section and in open position said lower edge of said lower section is extended downward away from said upper edge of said lower section, wherein the upper and lower sections are separate and distinct from each other both in open and in closed positions, and a waist belt for carrying the pouch; the waist belt having a tapered section connected to each of two opposite sides of the pouch, each tapered section having a wider end and a narrower end, with the wider end adjacent the pouch.

2. A runner's writing pad, pencil and recorder pouch according to claim 1 further comprising means attached to the pouch adapted for receiving a belt.

3. A runner's writing pad, pencil and recorder pouch according to claim 1 further comprising a clip attached to a rear surface of the pouch for engaging a waistband of a garment worn by a user of the pouch.

4. A runner's writing pad, pencil and recorder pouch according to claim 1 further comprising a pocket adapted for receiving an identification card.

5. A runner's writing pad, pencil and recorder pouch according to claim 1 wherein said lower section comprises a closable pocket adapted for receiving coins.

6. A runner's writing pad, pencil and recorder pouch according to claim 1 further comprising a pocket adapted for receiving keys.

7. A runner's writing pad, pencil and recorder pouch according to claim 1 wherein said upper section further comprises a pocket adapted for a writing instruction and a pocket adapted for receiving an identification card, and wherein said lower section comprises a closable pocket adapted for receiving coins and a pocket adapted for receiving keys.

8. A runner's writing pad, pencil and recorder pouch according to claim 1 wherein said lower section further comprises a pocket adapted for receiving a mini-tape recorder, radio or pager.

9. A runner's writing pad, pencil and recorder pouch according to claim 1 further comprising a rear surface layer of substantially stiff material.

10. A runner's writing pad, pencil and recorder pouch according to claim 1 wherein said rear surface layer comprises a member selected from the group consisting of waterproof fabric, leather and plastic.

11. A runner's writing pad, pencil and recorder pouch according to claim 10 wherein said rear surface layer further comprises a clip for fastening to a waistband of a garment.

12. A runner's writing pad, pencil and recorder pouch according to claim 1 further comprising a first fastening between said upper edge and said lower edge of said upper section of said pouch and a second fastening between said upper edge and said lower edge of said lower section of said pouch.

13. A runner's writing pad, pencil and recorder pouch according to claim 12 wherein said first fastening comprises a zip fastener extending around the perimeter of said upper section and said second fastening comprises a zip fastener extending around the perimeter of said lower section.

14. A runner's writing pad, pencil and recorder pouch according to claim 13 wherein said lower section further comprises a coin purse closed by a zip fastener.

15. A runner's writing pad, pencil and recorder pouch according to claim 1, wherein said pouch is waterproof.

16. A hands-free runner's writing pad, pencil and recorder pouch comprising:

a pouch comprising an upper section including an upper edge and a lower edge, wherein in closed position said upper edge of said upper section is folded forward and joined to and at said lower edge of said upper section and in open position said upper edge of said upper section is extended upward, away from said lower edge of said upper section, to expose access to a first pocket adapted for receiving a writing pad, and a lower section including an upper edge adjacent said lower edge of said upper section and a lower edge, wherein in closed position said lower edge of said lower section is folded forward and joined to and at said upper edge of said lower section and in open position said lower edge of said lower section is extended downward away from said upper edge of said lower section to expose access to a second pocket adapted for receiving a mini-tape recorder, radio or pager and a third pocket adapted for receiving coins, wherein the upper and lower sections are separate and distinct from each other both in open and in closed positions, and a waist belt for carrying the pouch; the waist belt having a tapered section connected to each of two opposite sides of the pouch, every tapered section having a wider end and a narrower end, with the wider end adjacent the pouch.

17. A runner's writing pad, pencil and recorder pouch according to claim 16 further comprising a fourth pocket adapted for receiving keys.

18. A runner's writing pad, pencil and recorder pouch according to claim 17 wherein said fourth pocket is attached to an outer surface of said third pocket.

19. A runner's writing pad, pencil and recorder pouch according to claim 16 wherein said second pocket comprises elastic fabric for securely holding the mini-recorder.

20. A runner's writing pad, pencil and recorder pouch according to claim 16 wherein said second pocket comprises a flap including a fastener for closing said second pocket.

21. A runner's writing pad, pencil and recorder pouch adapted for being carried at a user's waist while running and comprising:

a pouch comprising:

an upper section including an upper edge and a lower edge, wherein in closed position said upper edge of said upper section is folded forward and joined to and at said lower edge of said upper section and in open position said upper edge of said upper section is extended upward, away from said lower edge of said upper section, to expose access to a pocket adapted for receiving a writing pad or a mini-tape recorder, radio or pager, a lower section including an upper edge adjacent said lower edge of said upper section and a lower edge, wherein in closed position said lower edge of said lower section is folded forward and joined to and at said upper edge of said lower section and in open position said lower edge of said lower section is extended downward away from said upper edge of said lower section, wherein said pocket opening into said upper section extends downward behind said lower section substantially as far as a fold line for folding said lower section forward and upward for closing said lower section, and wherein the upper and lower sections are separate and distinct from each other both in open and in closed positions.

* * * * *